US007946004B2

(12) United States Patent
Cameron et al.

(10) Patent No.: US 7,946,004 B2
(45) Date of Patent: May 24, 2011

(54) RECLOSABLE FASTENER WITH SLIDER FOR HIGH-PRESSURE PROCESSING

(75) Inventors: David P. Cameron, Canandaigua, NY (US); Stephen A. Meli, Chicago, IL (US)

(73) Assignee: Pactiv Corporation, Lake Forest, IL (US)

( * ) Notice: Subject to any disclaimer, the term of this patent is extended or adjusted under 35 U.S.C. 154(b) by 714 days.

(21) Appl. No.: 11/613,642

(22) Filed: Dec. 20, 2006

(65) Prior Publication Data

US 2007/0193000 A1 Aug. 23, 2007

Related U.S. Application Data

(60) Provisional application No. 60/752,648, filed on Dec. 20, 2005.

(51) Int. Cl.
*A44B 19/26* (2006.01)

(52) U.S. Cl. ..... 24/415; 24/399

(58) Field of Classification Search ..... None
See application file for complete search history.

(56) References Cited

U.S. PATENT DOCUMENTS

| | | | | |
|---|---|---|---|---|
| 3,103,049 | A * | 9/1963 | Hawley | 24/400 |
| 5,010,627 | A * | 4/1991 | Herrington et al. | 24/400 |
| 7,251,864 | B2 * | 8/2007 | Chang | 24/30.5 R |
| 7,269,883 | B2 * | 9/2007 | Savicki | 24/399 |
| 2003/0000050 | A1 | 1/2003 | Blythe et al. | |
| 2006/0168777 | A1 * | 8/2006 | Turvey et al. | 24/415 |

FOREIGN PATENT DOCUMENTS

| | | |
|---|---|---|
| EP | 0511616 | 11/1992 |
| WO | WO0076347 | 12/2000 |

* cited by examiner

*Primary Examiner* — Jack W. Lavinder
(74) *Attorney, Agent, or Firm* — Baker Botts LLP

(57) ABSTRACT

A fastener for a plastic bag includes first and second mutually engageable track portions and a slider for engaging and disengaging the track portions. In a preferred embodiment, the slider includes a core portion and an end portion. The core portion is made of a first material having a first preselected material property. The end portion is made of a second material having a second preselected material property and is arranged at opposing ends of the slider.

26 Claims, 14 Drawing Sheets

RECLOSABLE FASTENER WITH SLIDER FOR HIGH-PRESSURE PROCESSING

CROSS-REFERENCE TO RELATED APPLICATIONS

This application claims priority to U.S. Provisional Application Ser. No. 60/752,648, filed Dec. 20, 2005, the content of which is incorporated herein in its entirety.

BACKGROUND OF THE INVENTION

1. Field of the Invention

The present invention relates to a reclosable fastener with slider for use in reclosable packages. Particularly, the present invention is directed to such fasteners for use in high-pressure environments, such as in high-pressure pasteurization processes.

2. Description of Related Art

Plastic bags are in widespread use in a varied and diverse number of household and commercial applications. An advantage of plastic bags is the ease of opening and resealing of such containers. FIG. 13 shows a reclosable plastic bag 1300, which includes first and second opposing body panels 1340 connected to each other along a pair of sides 1345, 1347 and a bottom, in which the bottom extends between the pair of sides. The plastic bag 1300 includes a fastener, such as engageable tracks or a zipper 1330, extending along a mouth formed opposite the bottom of the plastic bag. The zipper 1330 generally includes a male track 1330*a* and a female track 1330*b*. The male track includes a male profile having a first depending fin or flange 1331*a* extending downward from the male profile. Likewise, the female track 1330*b* includes a female profile having a second depending fin or flange 1331*b* extending downward from the female profile. The first and second fins can be extruded separately from the body panels 1340 and then thermally fused to the respective first and second body panels 1340.

In some embodiments, known as press-to-close fasteners, the male and female tracks 1330*a*, 1330*b* are rolled or pressed into interlocking engagement so as to securely close the bag 1300. Alternatively, and as depicted in FIG. 13, a plastic slider 1310 can be provided to ride along the tracks 1330*a*, 1330*b* of the zipper 1330. If the slider 1310 is pulled in one direction, the bag 1300 is sealed closed; if the slider 1310 is pulled in the opposite direction, the bag 1300 is opened. For strength and longevity, a track end termination 1337 is usually desired. The termination 1337, among other things, strengthens the end of the zipper 1330, and prevents the slider 1310 from sliding off of the zipper 1330. Such termination 1337 can be in the form of a clip, as illustrated, or can be an integrally formed region of the tracks that is strong enough to meet the required design criteria. Such region can be made by fusing predetermined regions at the end of the zipper 1330, such as by heat or ultrasonic welding techniques.

Specific details regarding the operation of a conventional slider-operated resealable bag are set forth, for example, in U.S. Pat. No. 6,611,996, the entire disclosure of which is incorporated herein by reference.

Such conventional packages generally have been considered satisfactory for their intended purpose. However, when undergoing processing involving extreme environments, such as high pressurization, or those involving pressurization and heating, the presence of the slider can result in failure in some bag constructions.

Furthermore, certain zippered resealable bags include a header portion extending beyond the resealable track and slider. For example, the header can be sealed at its upper end by a packager or processor to form a resealable bag with a tamper-evident seal. This is desirable for consumer use to assure a secure seal, while the slider provides easy and reliable reclosable function.

FIG. 14 illustrates an example of a reclosable bag 1400 having a slider 1427 and first and second header portions 1418 and 1482 divided by a line of weakness 1484, such as a perforation or thinned material region. The figure illustrates a bag 1400 that has been filled with a product 1480 and sealed along a top edge 1483. The user can tear the sealed upper header 1482 along the line of weakness 1484, with the lower header portion 1418 remaining in tact. Seals 1472 along the sides and bottom, which define the extent of a storage region of the bag, are unaltered.

After opening or removal of the header 1482, the user may reseal the bag 1400 using the provided slider 1427, which travels along the track 1416 of the reclosable fastener 1428.

When processing a bag of this type under pressure, failure can occur due to the conventional slider preventing surrounding film from laying flat, thereby causing pockets of air between opposite panels of the header and air within the slider body 1427. Under pressure, the air within these pockets compresses and causes localized film stretching and failure of the film.

For the foregoing reasons, it is apparent that there remains a need for an efficient and economic system and method for preparing a zippered bag capable of withstanding pressurized treatment, particularly treatment at very high pressures.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with the purpose of the invention, as embodied and broadly described, the invention includes, in one aspect, a fastener for a plastic bag that includes first and second mutually engageable track portions and a slider for engaging and disengaging the track portions. In a preferred embodiment, the slider includes a core portion and one or more end portions. The core portion is made of a first material having a first preselected material property. The one or more end portion(s) are made of a second material having a second preselected material property and is arranged at opposing ends of the slider.

The first and second preselected material properties can be a preselected modulus of elasticity, hardness or other material property. In a preferred embodiment, the second material has a hardness and/or modulus of elasticity that are less than the first material. The core portion of the slider can be centrally located along a longitudinal axis of the slider. In a preferred embodiment, the core portion is made from polypropylene and the end portion of the slider is made of a thermoplastic elastomer.

The end portion can include a separate member at each opposing end of the slider or two end portions joined together by a connecting element. The core portion and the end portion of the slider can be joined by a press-fit, integrally molded, joined by an interference fit, or a solvent or heat weld. If integrally molded, the end portion can be molded over the core portion, covering an exterior surface of the core portion or alternatively molded adjacent to the core portion.

The invention includes, in another aspect, a slider for a plastic bag having a first track portion and a second track portion engageable with the first track portion. The slider is capable of engaging and disengaging the first track portion, respective the second track portion. The slider includes a core portion made of a first material, having a first preselected material property and an end portion made of a second material, having a second preselected material property. The end portion is arranged at opposing ends of the slider.

In accordance with another aspect, the invention includes a method of processing a product in a plastic bag having a fastener with slider. The method includes providing a plastic bag having first and second track portions and a slider to engage and disengage the first track portion respective the second track portion, inserting a product into the plastic bag and processing the plastic bag and product in a pressurized environment. The slider includes a core portion made of a first material having a first preselected material property and an end portion made of a second material arranged at opposing ends of the slider. The second material has a second preselected material property.

In accordance with still another aspect, the invention includes a method of processing a product in a plastic bag comprising providing a plastic bag having a reclosable fastener with first and second track portions, inserting a product into the plastic bag, processing the plastic bag and product in a pressurized environment, and installing a slider on the reclosable fastener, the slider being capable of engaging and disengaging the first track portion respective the second track portion.

The invention can further include processing the plastic bag and product by subjecting the plastic bag and product to a predetermined pressure, drying at least a predetermined region of the plastic bag, and sealing the plastic bag in the predetermined region.

In accordance with a further aspect of the invention, a method of packaging a product is provided. The method includes providing two opposing body panels, forming a pouch by sealing the body panels in a predetermined region, inserting a product to be sealed into the pouch, treating the product and the pouch in a predetermined process, affixing first and second track portions each to a respective body panel, and installing a slider on the first and second track portions.

The treatment of the product can include subjecting the product and pouch to a predetermined pressure, wherein the predetermined pressure is higher than ambient pressure.

It is to be understood that both the foregoing general description and the following detailed description are exemplary and are intended to provide further explanation of the claimed invention.

The accompanying drawings, which are incorporated in and constitute part of this specification, are included to illustrate and provide a further understanding of the methods and systems of the invention. Together with the description, the drawings serve to explain the principles of the invention.

DETAILED DESCRIPTION OF THE PREFERRED EMBODIMENT

Figure 1:
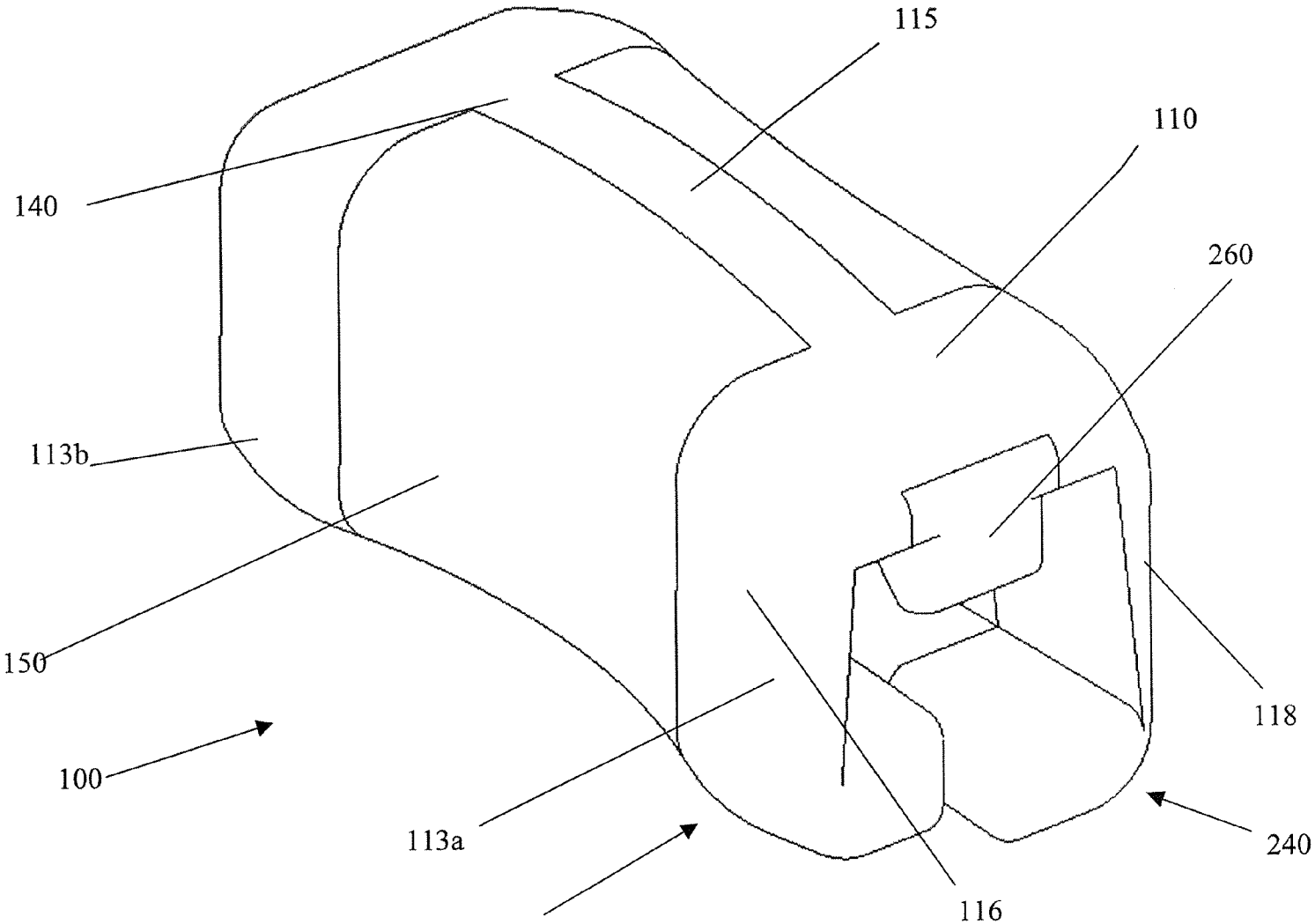
FIG. 1 is an isometric front view of a representative embodiment of a slider in accordance with the invention.

Reference will now be made in detail to the present preferred embodiments of the invention, examples of which are illustrated in the accompanying drawings. The method and corresponding steps of the invention will be described in conjunction with the detailed description of the subject reclosable fastener.

The methods and systems presented herein can be used for packaging products, particularly in a pressurized environment. The methods and systems described herein are particularly suited for packaging food products undergoing high-pressure pasteurization or other pressurized processing.

Moreover, the methods and systems described herein can be used to enhance ergonomic aspects and improve the tactile sensation of sliders for reclosable packages.

In accordance with one aspect of the invention, a slider is provided for a reclosable bag having first and second, mutually engageable track portions. The slider engages and disengages the first and second track portions. The slider includes a core portion made of a first material, having a first predetermined hardness. The slider further includes at least one end portion made of a second material, arranged at opposing ends of the slider. The second material has a second predetermined hardness, which is less than the first predetermined hardness. For the purposes of explanation and illustration, and not limitation, an exemplary embodiment of the subject slider in accordance with the invention is shown in FIG. 1 and is designated generally by reference character 100.

Referring initially to FIG. 1, a slider 100 according to one embodiment of the present invention is illustrated. The slider 100 is constructed to have properties of a soft material proximate its ends and a relatively hard material within the core portion, which is in engagement with the tracks of the bag on which the slider is mounted. This is preferably achieved by manufacturing the slider out of a plurality of materials but may be achieved in other manners, such as by altering the material properties of one or more selected portions of the slider by treating only that portion of the slider. For example, certain polymers can be hardened when subjected to ultraviolet light or by other cross-linking techniques.

In a preferred embodiment, the slider 100 is advantageously manufactured in a multi-stage or "multi-shot" molding process. In such processes, a first portion of the slider, such as the core, is molded in a first mold cavity, after which the first portion is placed into a second mold cavity wherein a second portion, such as the end portion is molded. The second portion can be molded adjacently to the first portion, or can be molded to cover the first portion in part or in its entirety.

Alternative manufacture techniques can be used to form and assemble the portions of the slider, if desired.

Through this type of process, portions of the slider can be manufactured from different materials to achieve a slider having tailored exterior material characteristics, even though such material might not otherwise be suitable for manufacture of an entire slider.

By using such multi-stage molding processes, a variety of configurations for the core and end portions can be provided. For example, the end portions can form a layer over a core portion. Additionally, the core portion can be configured to form a "skeleton," such that material from the second and subsequent molding stages can cover and/or be injected between the core portion.

Figure 13:
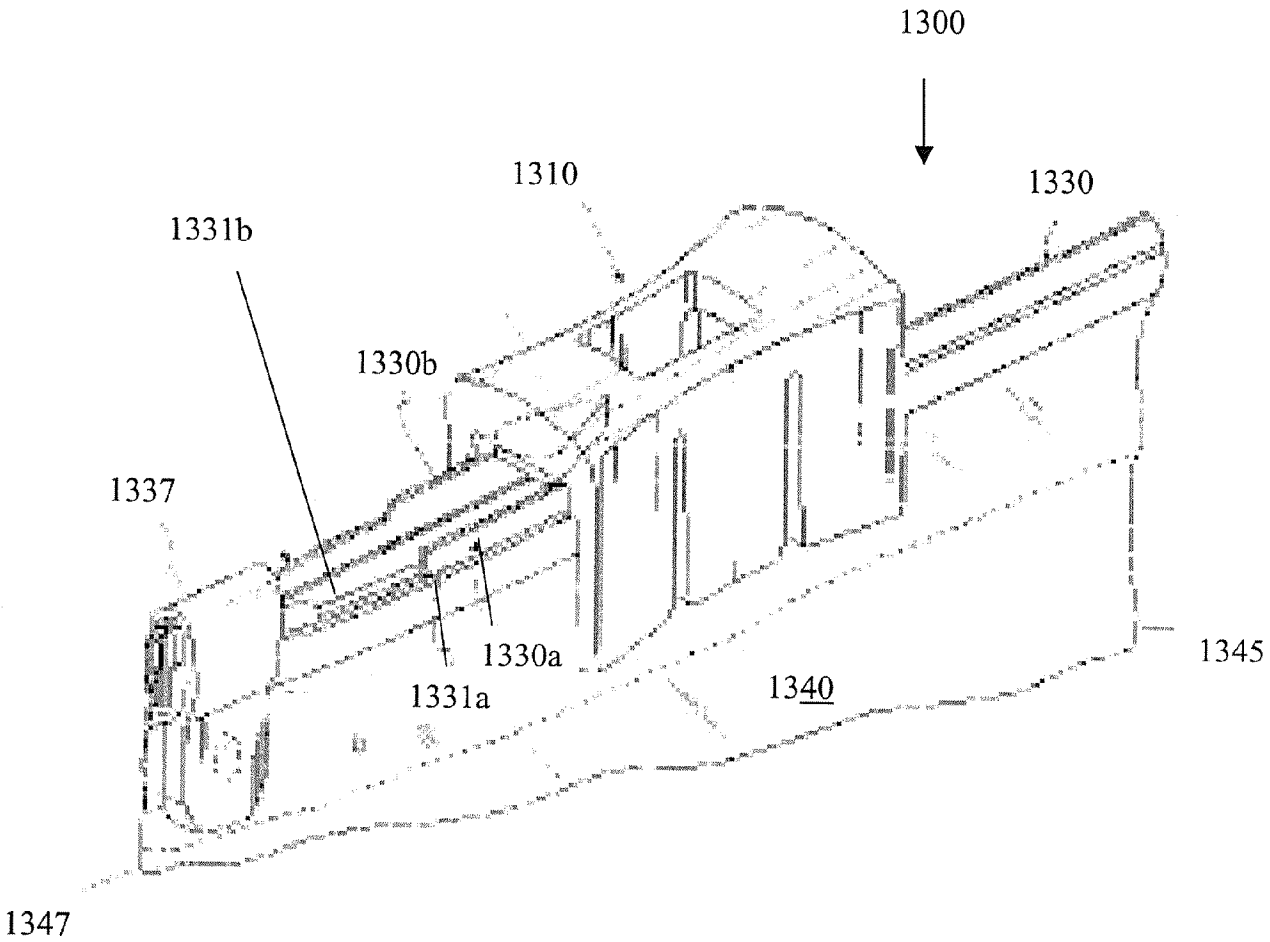
Figure 13 (prior art)
FIG. 13 is a partial isometric view of a slider and bag in accordance with the prior art.
Figure 14:
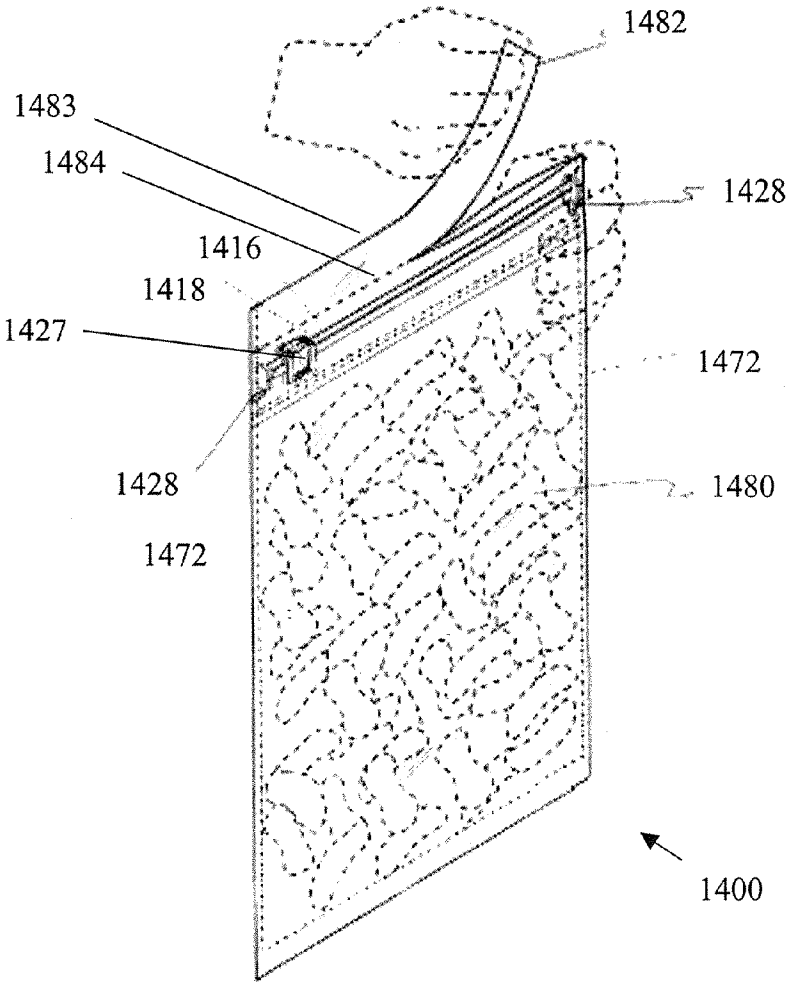
Figure 14 (prior art)
FIG. 14 is an isometric view of a slider and bag having a header portion in accordance with the prior art.

The subject slider benefits from having a core portion that is sufficiently rigid to keep the slider from flexing and falling from a conventional track (such as illustrated in FIGS. 13 and 14), and having end portions that are sufficiently soft to comply with an applied pressure to the extent desired.

In the embodiment illustrated in FIG. 1, the slider generally includes two portions. The core portion 150 provides a majority of the structure for and subsequent strength of the slider 100. The slider 100 is an inverted generally U-shaped member, as is the core portion 150, itself. Accordingly, when constructed from a sufficiently rigid material, the core portion 150 can retain the slider 100 on the track. The core portion 150 further provides the components that function to engage and disengage the track members described above. The second portion 110 of the slider embodied herein includes end portions 113*a* and 113*b*. A connecting rail 115 is formed along the spine of the slider 100 to connect the end portions. The connecting rail 115 thus facilitates assembly of the slider 100 with only two parts, if formed separately. Further, the rail 115 provides a region at which the parts can be attached by desired means, including but not limited to an adhesive connection, press-fit, interference fit, mechanical interlocking, solvent welding, heat welding, sonic welding or another means that yields a sufficient bond to achieve the desired longevity and strength of the slider 100.

In a preferred embodiment, the end portions 113*a*, 113*b* are integrally molded with the core portion 150 in a multi-stage or multi-shot molding process. In such embodiments, the connecting rail 115 defines a bridge between two molded elements, advantageously eliminating the need for multiple injection nozzles that would otherwise be required, thereby reducing tooling costs. As noted above, the connecting rail 115 therefore simplifies manufacture and assembly of the slider. If desired, however, separate end portions can be provided as two or more members to be attached to the core portion. Alternatively, and as previously noted, the slider can be formed from a single member that is processed to create a more rigid core portion and less rigid end portions, if desired.

As illustrated, the slider 100, as a whole, comprises a top 140, a pair of sides or side walls 116 and 118 depending downwardly from the top 140, and at least one separation member or finger 260 located on an underside of the top 140. The separation finger 260 is positioned between the sides 116 and 118, which is best seen from the bottom isometric view of the slider 100 depicted in FIG. 2.

At the lower end of each side 116 and 118 are inwardly extending shoulders 220 and 240, respectively, which cooperate with the separation finger 260 to assist in opening and closing the fastener track on which the slider 100 is mounted. The shoulders 220 and 240 engage an underside of the fastener track to inhibit or prevent the slider 100 from being lifted off profile edges while the slider 100 straddles the fastener track. Alternative embodiments of finger and shoulder configurations can be used in accordance with the present invention, such as those described in U.S. Patent Publication Number 2005/0115033 and U.S. Pat. No. 6,611,996, each of which are incorporated by reference herein in its entirety.

As embodied herein, for the purpose of illustration and not limitation, the shoulders 220 and 240 are formed of shoulder segments 220*a*-220*c* and 240*a*-240*c*, respectively. The core portion 150 includes shoulder segments 220*c* and 240*c*. The second portion 110 includes the two end portions 113*a,b*. The first end portion 113*a* includes shoulder segments 220*a* and 240*a*. The second end portion 113*b* includes shoulder segments 220*b* and 240*b*. In the illustrated embodiment, the separate shoulder segments work in conjunction to secure the slider 100 to the track. It is contemplated, however, that the shoulder segments 220*c* and 240*c* of the core portion 150 will constitute the majority of flexural rigidity and strength of the slider for preventing removal of the slider 100 from the track, whereas the remaining shoulder segments will minimize hard and/or sharp edges to minimize damage to the panels of the reclosable bag during processing, such as during high pressure pasteurization. The relatively rigid core portion 150 also helps maintain the slider 100 in alignment with the track, preventing the slider from "riding" up or down, relative to the track, thereby also keeping the separating finger 260 in correct position, relative to the tracks.

Figure 2:
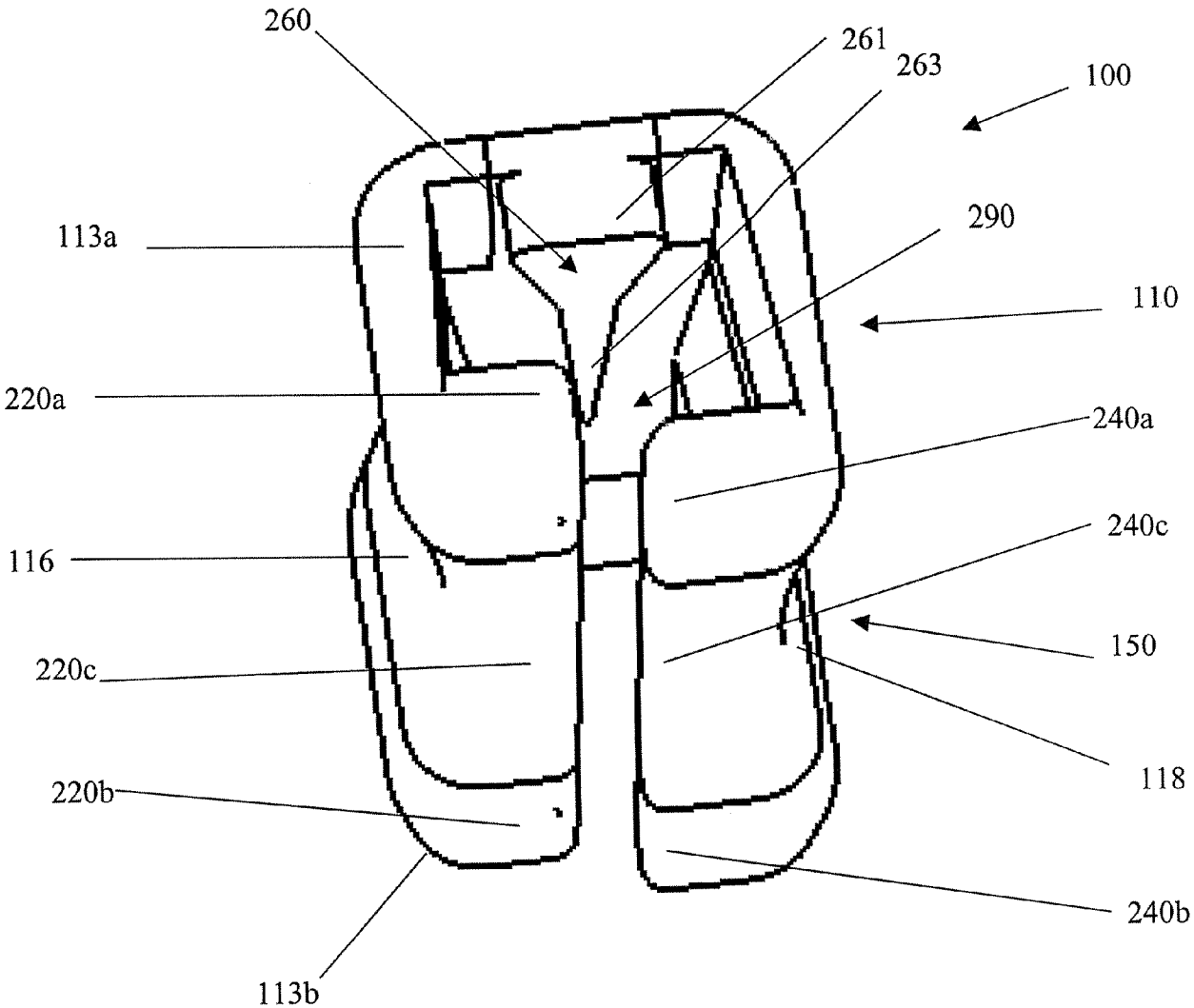
FIG. 2 is a bottom isometric view of the slider shown in FIG. 1.

As shown in FIG. 2, the separation finger 260 of the slider 100 generally has a wide portion 261 and a narrow portion 263. The separation finger 260 with the wide and narrow portions 261 and 263, respectively, interacts with mating portions of the fastener to engage or disengage the first and second profiles of the fastener. This interaction engages and disengages the fastener in the manner described in U.S. Pat. No. 5,007,143, which is incorporated herein by reference in its entirety.

The core portion 150 is made from a material that is sufficiently rigid to prevent undesired removal of the slider 100 from the track. The material is also preferably selected such that it interacts appropriately with the material of the track and the bag material itself. While the softer end portions 113*a,b* can contact the track and the bag, it is contemplated that the core portion 150 maintains the integrity of the mating relationship with the track. Accordingly, the material used for the core portion 150 preferably is relatively resistant to wear and fatigue. Since the inner channel 290 of the core portion 150 slides along the track, and the shoulders 220, 240 contact portions of the track and bag, the materials of the slider 100 and the bag and track are selected to be suitable to result in a smoothly sliding slider, having a relatively low coefficient of friction therebetween.

For the purpose of example, the bag panels can be made from any of a variety of suitable films, such as, but not limited to polyethylene (PE), ethylene vinyl alcohol (EVOH), Nylon, polyethylene/polyethylene terephthalate laminates, polyethylene/polyethylene and ethylene vinyl alcohol laminates, coextruded polyethylene/polyethylene laminates, Nylon/polyethylene terephthalate/polyethylene laminates, or combinations thereof. Likewise, the track can be formed of the same material as the bag panel, or a different material, including, but not limited to low-density polyethylene (LDPE), high-density polyethylene (HDPE), ultra-low-density polyethylene (ULDPE), cyclic olefin copolymer, ethylene vinyl alcohol, or combinations thereof. The core portion of the slider 150 can be made from any suitable plastic such as polypropylene, a urethane material, a polyethylene material, polybutylene terephthalate (PBT), polyethylene terephthalate, Nylon, acetal or combinations thereof, while the end portions 113*a,b* are made from a softer plastic, such as a urethane material, rubber, thermoplastic olefin (TPO), very low density polyethylene (VLDPE) or plastomers but preferably a thermoplastic elastomer (TPE). The end portions, in certain embodiments, are preferably made from a material having a hardness of about 50-90+/−5 on the Shore A scale or about 12-40+/−5 on the Shore D scale, or an equivalent hardness as otherwise measured.

For the purpose of providing an example, the modulus of elasticity for materials used in the core portion can range from about 600 MPa to about 4000 MPa, but preferably is about 1600 MPa, and the modulus of elasticity for materials used in the end portions can range from about 1 MPa to about 35 MPa, but preferably is about 7 MPa.

Preferably, the end portions 113*a*, 113*b* are of a material softer than the core portion, so as to provide a relatively soft the edge for the slider 100. The end portions preferably have a smoothly contoured profile, such as shown for purpose of example, and are constructed of a relatively soft material, compared with the relatively stiff or rigid material of the core portion 150 that is necessary to impart the desired resistance to flexure and wear. Accordingly, the second portion 110, including end portions 113*a*, 113*b*, is constructed from a material that is compliant under the contemplated treatment conditions. When treating the bag and an item contained in the bag under an increased pressure or increased pressure and temperature, it is desired that the ends of the slider do not impart holes in an overlying polymeric film, such as a header portion of a bag.

In addition to allowing treatment of reclosable bags under high pressure, sliders in accordance with the invention can be configured to enhance ergonomic aspects of sliders of reclosable containers. Preferably, a material that provides a favorable tactile sensation to the user can be utilized. For example, while rubber and rubber-like materials provide a secure, slip-resistant grip, such materials are usually relatively soft and therefore not suitable for the core portion. Accordingly, providing a slider made from multiple materials can advantageously result in a slider with desirable characteristics in one portion, while accommodating alternate desired characteristics in another portion.

Figure 3:
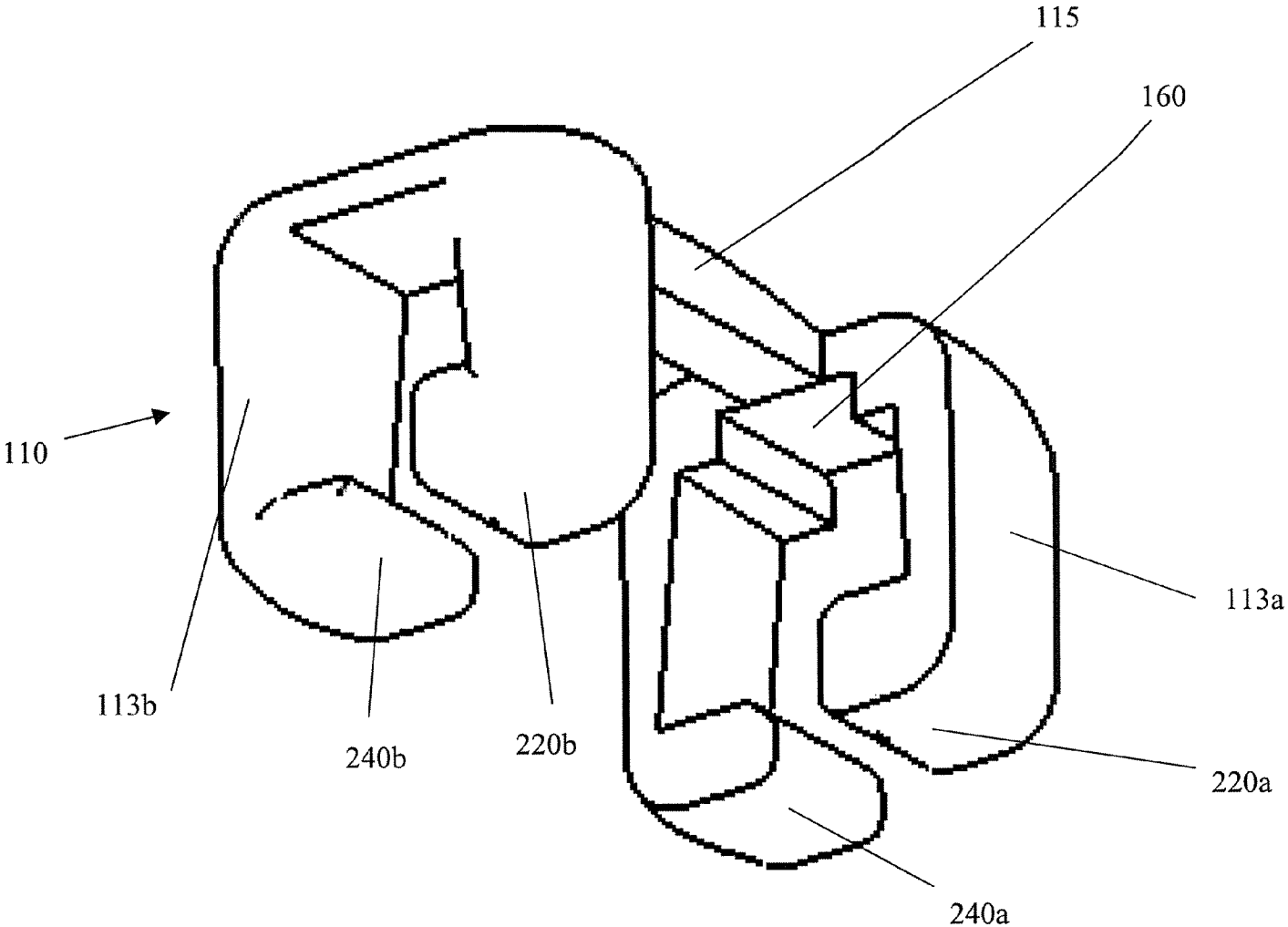
FIG. 3 is an isometric view of end portions of the slider shown in FIG. 1.

FIG. 3 more clearly illustrates the second portion 110 of the slider 100, illustrated in FIG. 1, which in this embodiment includes end portions 113*a,b* and connecting rail 115. The second portion 110 is illustrated alone, without the core portion 150 for clarity. Any of a variety of suitable alternative configurations having a smooth contour, preferably without exposed sharp corners, can be used. As previously noted, these portions can be fabricated separately and then assembled, or can be formed by multi-stage molding techniques, or of a single material that is selectively processed, such as by cross-linking, to form the desired portions.

Figure 4:
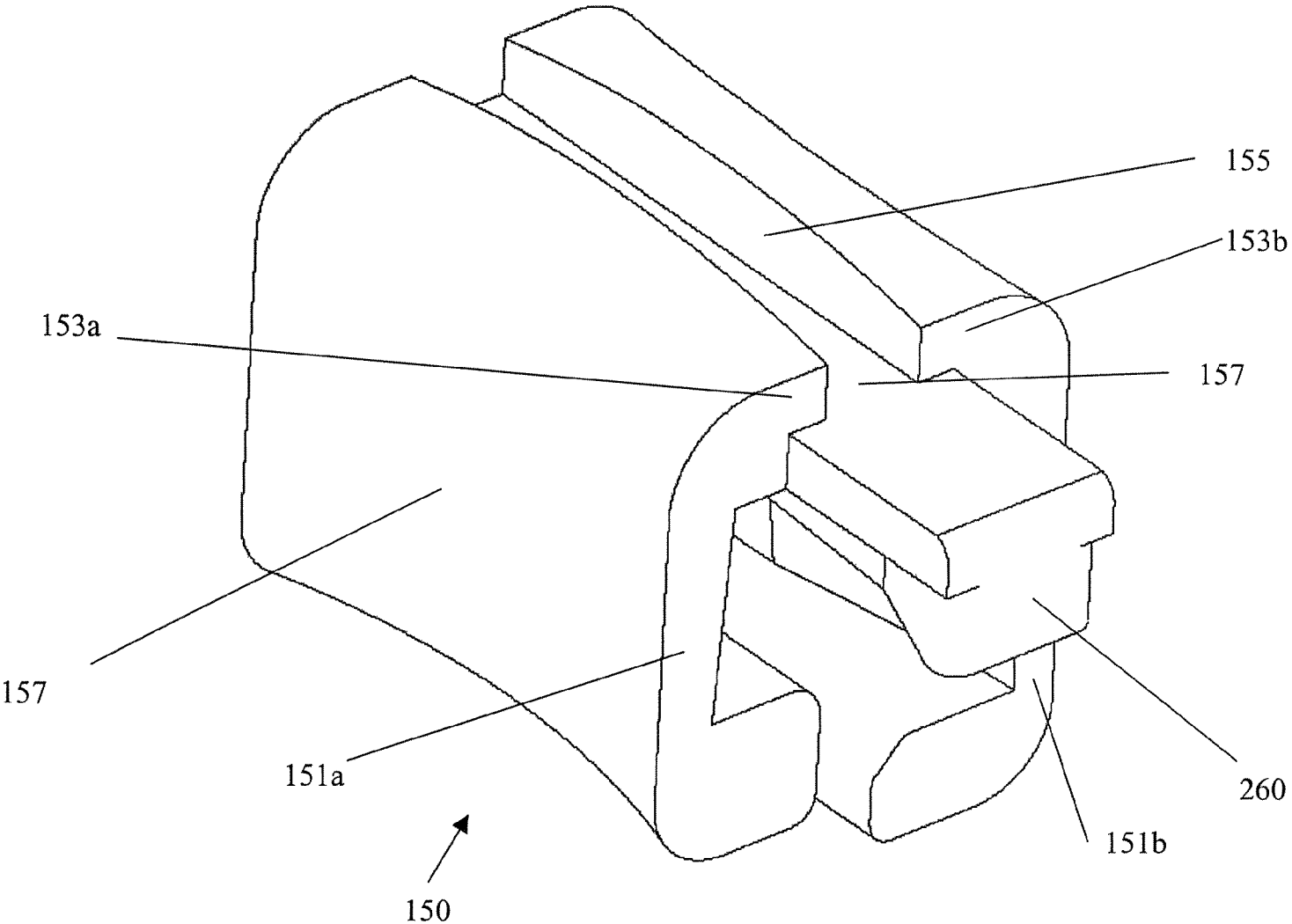
FIG. 4 is an isometric view of a core portion of the slider shown in FIG. 1.
Figure 5:
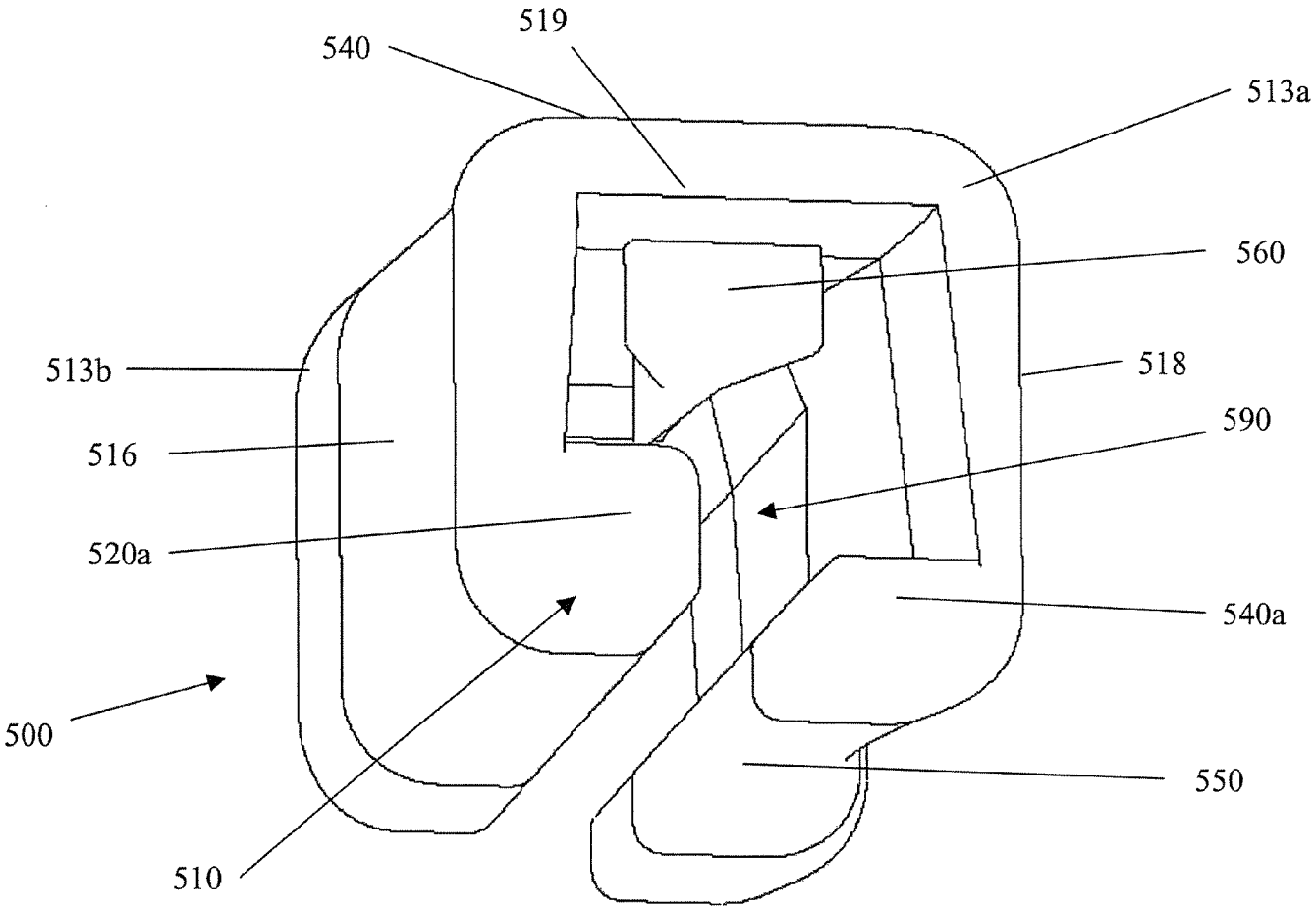
FIG. 5 is a rear isometric view of an alternate embodiment of a slider in accordance with the invention.
Figure 6:
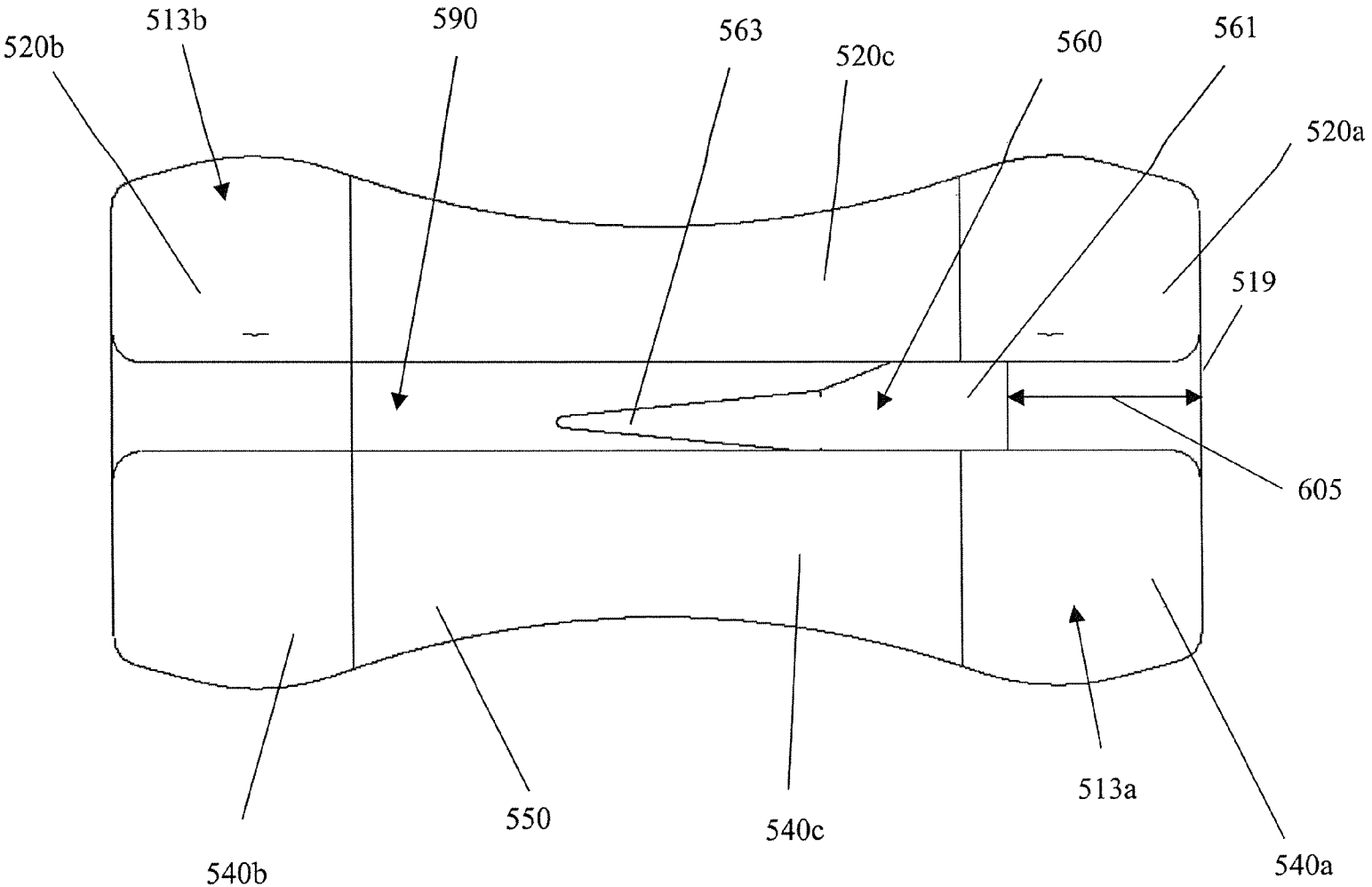
FIG. 6 is a bottom view of the slider shown in FIG. 5.
Figure 7:
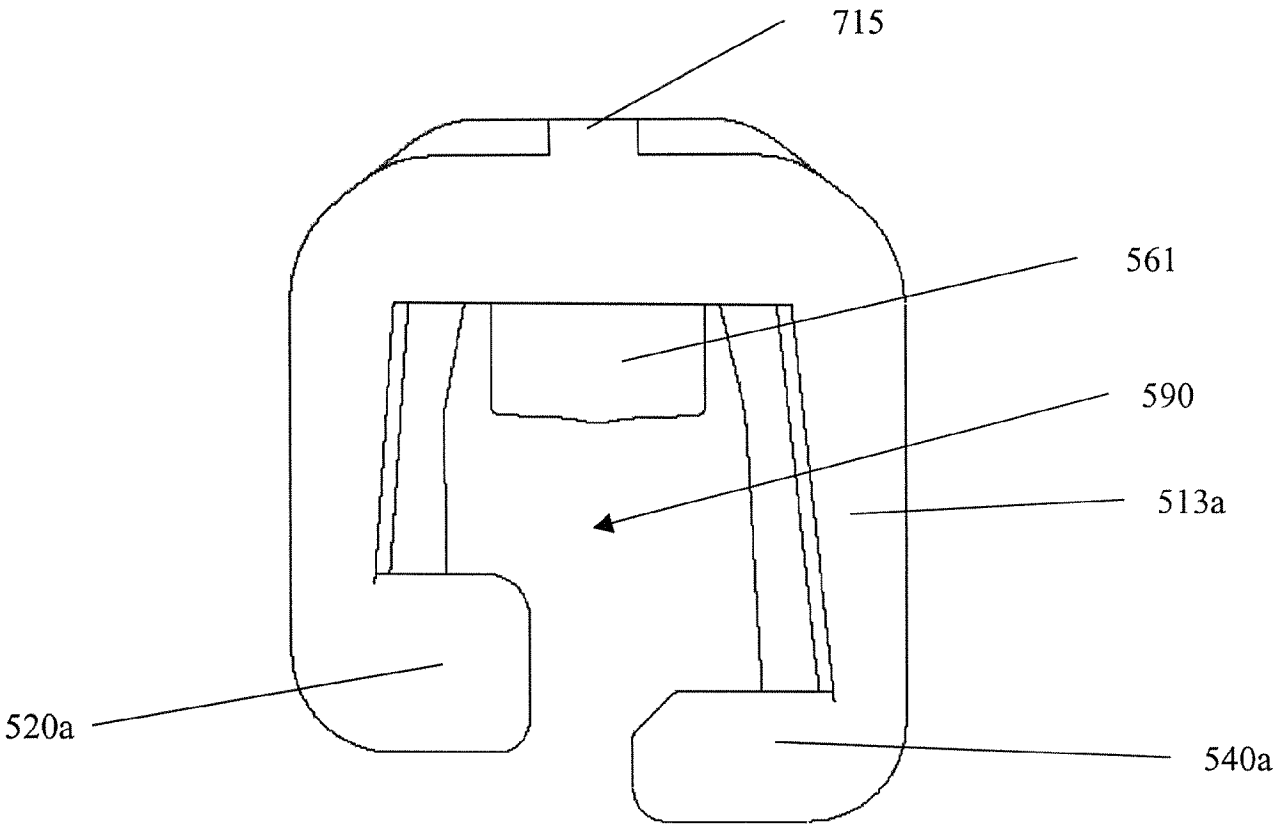
FIG. 7 is a rear end view of the slider shown in FIG. 5.
Figure 8:
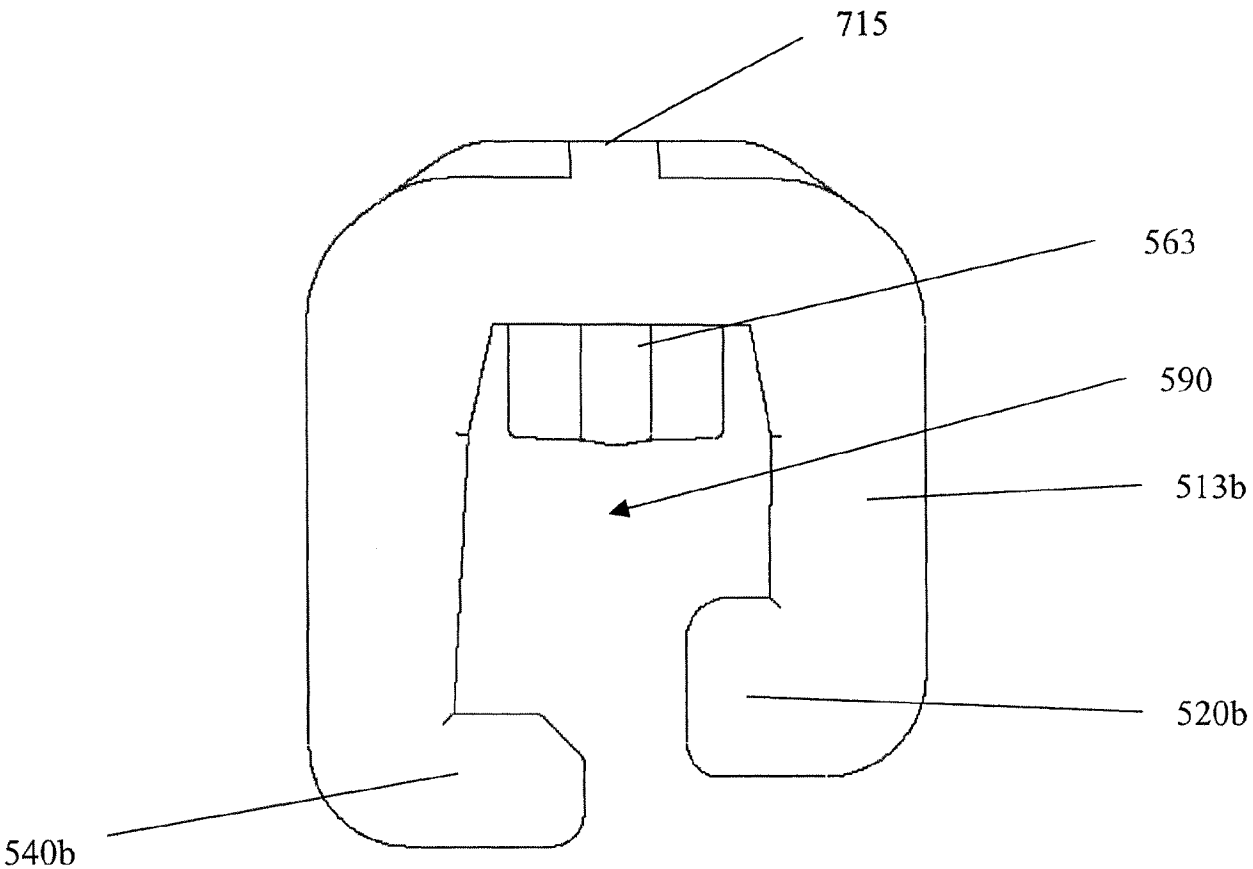
FIG. 8 is a front end view of the slider shown in FIG. 5.

FIG. 4 illustrates the core portion 150 of the embodiment of FIG. 1, alone for clarity. The core portion includes a groove 155 into which the rail portion 115 of the second portion 110 is secured or integrally formed, such as in a multi-stage molding process. As embodied herein, the core portion 150 includes one or more connecting members 157 between core halves 151*a* and 151*b*. Such a connecting member can span between upper edges 153*a* and 153*b* so that the core halves 151*a* and 151*b* are formed as a single unit.

Alternatively, the core portion 150 can be constructed in two separate halves and held together through attachment to the rail 115 of the second portion 110, if made of suitable materials.

In the embodiment illustrated in FIG. 4, the separating finger 260 is integrally formed with the core portion 150 and extends beyond the core halves 151*a* and 151*b*. In this manner, the harder, more wear resistant material of the core portion contacts the track, rather than the softer material of the end portions. The protruding separating finger is disposed within a recess 160 in the underside of one end portion 113*a*, as seen in FIG. 3. The end portion 113*a* generally covers or wraps around the exterior portion of the protruding separating finger 260, thereby preventing the relative rigidity of the separating finger 260 from damaging the plastic bag during processing.

In accordance with the invention, the slider is preferably made of material suitable for withstanding high pressure and/or high temperature environments. For example, if used for high-pressure processing, the conditions that the end portions 113*a,b* can experience include a pressure of between about 50 psi and 100,000 psi, typically between 50 psi and 89,000 psi, and/or a temperature between about 34° F. and 130° F., for a period of time between about 0 and 300 seconds. A process time of approximately 3 minutes is typical. These ranges are for the purpose of providing examples and not limitation. The materials used, therefore, can be selected according to the specific conditions under which a specific bag is to be treated. As set forth above, however, materials also can be chosen based on the tactile or aesthetic sensation desired.

As set forth above, the slider of the present invention is constructed with properties of both soft and hard materials; specifically, a soft portion at its ends, and yet the overall rigidity capable of retaining the slider on the track on which it is mounted. As set forth above, this can be accomplished by providing a core portion made from a first material and second portion made of a different material, each having the prescribed material properties. Alternatively, the slider can be made of a single material having a portion of the slider 150 that is treated to alter its material properties. For example, the slider can be constructed from a material that is hardened by a specific frequency of electromagnetic radiation, such as ultraviolet light, or treated through a chemical process to achieve such result. In such an instance, a portion, such as the central region illustrated in the above figures as the core region 150, can be subjected to such radiation, while the ends 113*a*, 113*b* are substantially shielded from such radiation. Thus, a slider having dual properties but a single material can be achieved.

Alternatively still, the desired properties of the slider can be imparted by providing the slider with an internal skeleton having a more rigid structure to achieve the necessary flexural rigidity for the slider, and then over-molding the skeleton with a relatively soft material to provide the desired end characteristics.

FIGS. 5-12 illustrate a preferred embodiment of the subject slider. The embodiment of these figures is generally similar to that of FIGS. 1-4, although the separating finger or "plow" 560 is set back by a distance 605 (FIG. 6) from a rear edge 519 of the slider. This relative positioning is particularly advantageous in very high-pressure environments by further concealing the separating finger 560 from contact with any portion of the bag film.

In environments without extremely high pressure and/or when sufficiently soft materials are used for the core portion 550, such a setback from the slider edge 519 may not be as desired. Conversely, in even higher pressure environments, and/or when harder core materials are used, the setback may be increased to further limit possible damage to a package on which the slider is installed.

FIGS. 5-8 respectively illustrate isometric, bottom, rear end and front end views of a slider in accordance with the invention, wherein the separating finger 560 is set back from the edge of the slider. As with the embodiment of FIG. 1, the separating finger 560 includes a wide end 561 and a narrow end 563.

The subject slider of this embodiment also benefits from having a core portion that is sufficiently rigid to keep the slider from flexing and detaching from a track, and having end portions that are sufficiently soft to comply with an applied pressure to the extent desired when undergoing treatment.

In the embodiment illustrated in FIGS. 5-12, the slider 500 includes two portions. The core portion 550 provides a majority of the structure for and subsequent strength of the slider 500. The slider 500 is an inverted generally U-shaped member, as is the core portion 550. When constructed from a sufficiently rigid material, the core portion 550 can retain the slider 500 on the track (shown in FIGS. 13-14). The core portion 550 further provides the components that function to engage and disengage the track members described above. The second portion 510 of the slider 500 includes end portions 513*a* and 513*b*. A connecting rail 715 can be provided along the spine of the slider 500 to connect the end portions. The connecting rail 715 facilitates assembly of the slider 500, allowing the use of only two portions, as previously described.

Further, the rail 715 also provides a region at which the portions can be attached by desired means, including but not limited to an adhesive connection, press-fit, interference fit, mechanical interlocking, solvent welding, heat welding or another means that yields a sufficient bond strength to achieve the desired longevity and strength of the slider 500.

In a preferred embodiment, the end portions 513*a*, 513*b* are integrally molded with the core portion 550 in a multi-stage or "multi-shot" molding process. In this case, the connecting rail 715 defines as a bridge between two molded elements, advantageously eliminating the need for multiple injection nozzles that would otherwise be required, thereby reducing tooling costs. The connecting rail 715 allows the use of only one injection nozzle to inject the material for each of the end portions 513*a*, 513*b*, rather than a dedicated nozzle for each portion. As noted above, the connecting rail 715 therefore simplifies manufacture and assembly of the slider. If desired, however, separate end portions can be provided as two or more members to be molded on or otherwise attached to the core portion.

Alternatively, and as previously noted, the slider can be formed from a single member that is processed to create a more rigid core portion and less rigid end portions, if desired.

As illustrated, the slider 500, as a whole, includes a top 540, a pair of sides or side walls 516 and 518 depending downwardly from the top 540, and at least one separation member or finger 560 located on an underside of the top 540. The separation finger 560 is positioned between the sides 516 and 518, which is best seen from the bottom isometric view of the slider 500 depicted in FIG. 6.

At the lower end of each side 516 and 518 are inwardly extending shoulders 520 and 540, respectively, which cooperate with the separation finger 560 to assist in opening and closing the fastener track on which the slider 500 is mounted. The shoulders 520 and 540 engage an underside of the fastener track to inhibit or prevent the slider 500 from being lifted off profile edges while the slider 500 straddles the fastener track. Alternative embodiments of finger and shoulder configurations can be used in accordance with the present invention.

In the embodiment of FIGS. 5-12, as with the embodiment of FIG. 1, for the purpose of illustration and not limitation, the shoulders 520 and 540 are formed of shoulder segments 520*a-c* and 540*a-c*, respectively. The core portion 550 includes shoulder segments 520*c* and 540*c*. The second portion 510 includes the two end portions 513*a,b*. The first end portion 513*a* includes shoulder segments 520*a* and 540*a*. The second end portion 513*b* includes shoulder segments 520*b* and 540*b*. In the illustrated embodiment, the separate shoulder segments work in conjunction to secure the slider 500 to the track. It is contemplated, however, that the shoulder segments 520*c* and 540*c* of the core portion 550 will constitute the majority of flexural rigidity and strength of the slider for preventing removal of the slider 500 from the track, whereas the remaining shoulder segments will minimize hard and/or sharp edges to minimize damage to the panels of the reclosable bag during processing. The relatively rigid core portion 550 also helps maintain the slider 500 in alignment with the track, preventing the slider from "riding" up or down, relative to the track, thereby also keeping the separating finger 560 in correct position, relative to the tracks.

As will be noted, in the illustrated embodiment, the height of the channel 590 (FIGS. 5-7) into which the track fits, is higher on one side than the other. That is, in FIG. 7, the channel 590 is higher on the side of the slider near shoulder 540*a*, than it is near 520*a*. This configuration allows for the appropriate geometry to allow the reclosable tracks to engage and disengage one another.

Figure 9:
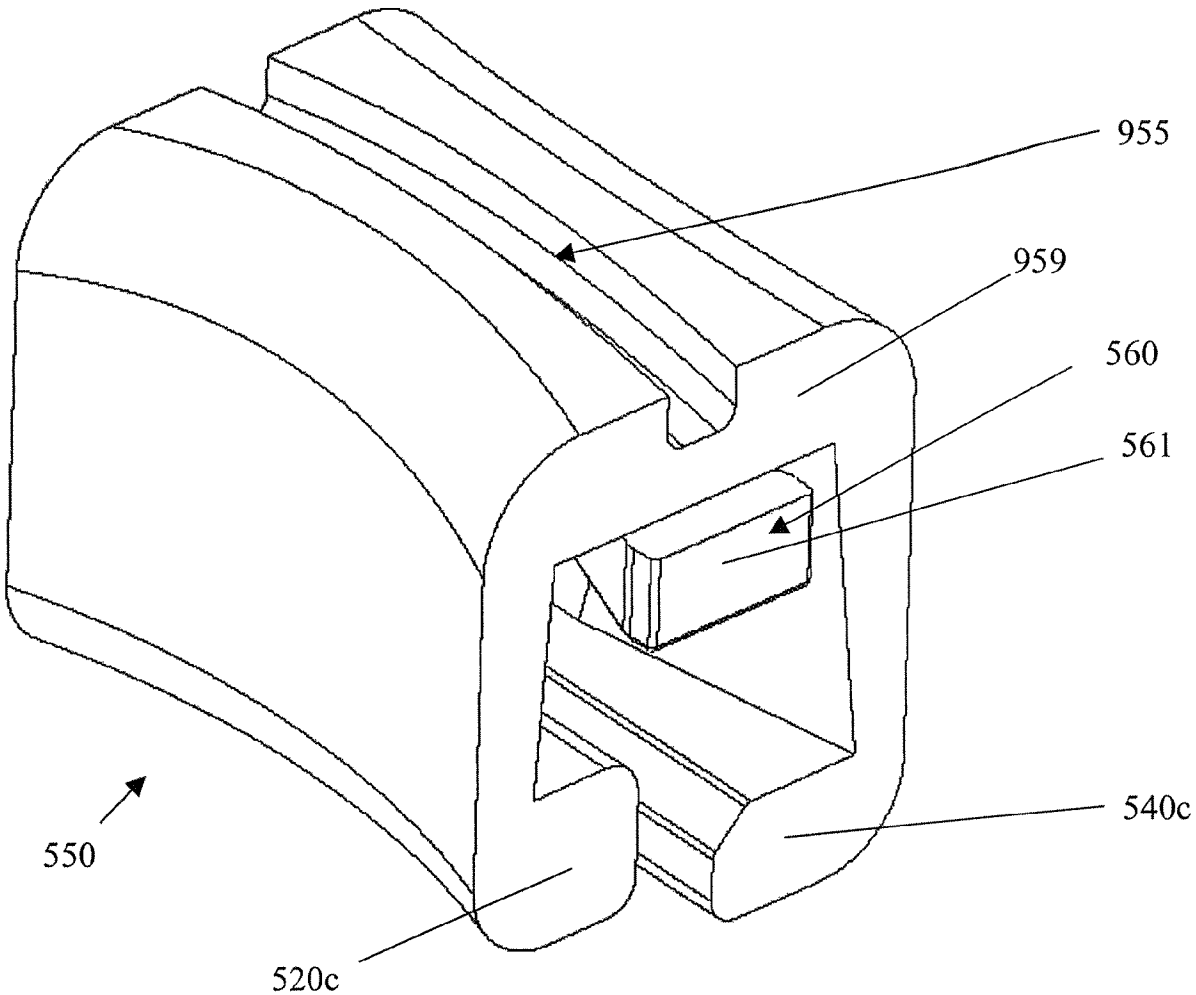
FIG. 9 is a rear isometric view of a core portion of the slider shown in FIG. 5.

FIG. 9 illustrates a core portion 550 of the embodiment of the slider shown in FIGS. 5-8. As can be seen, the separating finger 560 protrudes slightly from below an end face 959 of the core portion 550. Preferably, the separating finger 560 is disposed away from the edge 519 of the slider to minimize damage to the film during high pressure processing. If desired, the separating finger 560 need not extend past the face 959 of the core portion 550. The channel 955 provides an interface for the rail 715 of the end portion 510 and/or a passageway for material to flow when the slider 500 is molded in a multi-stage molding process.

Figure 10:
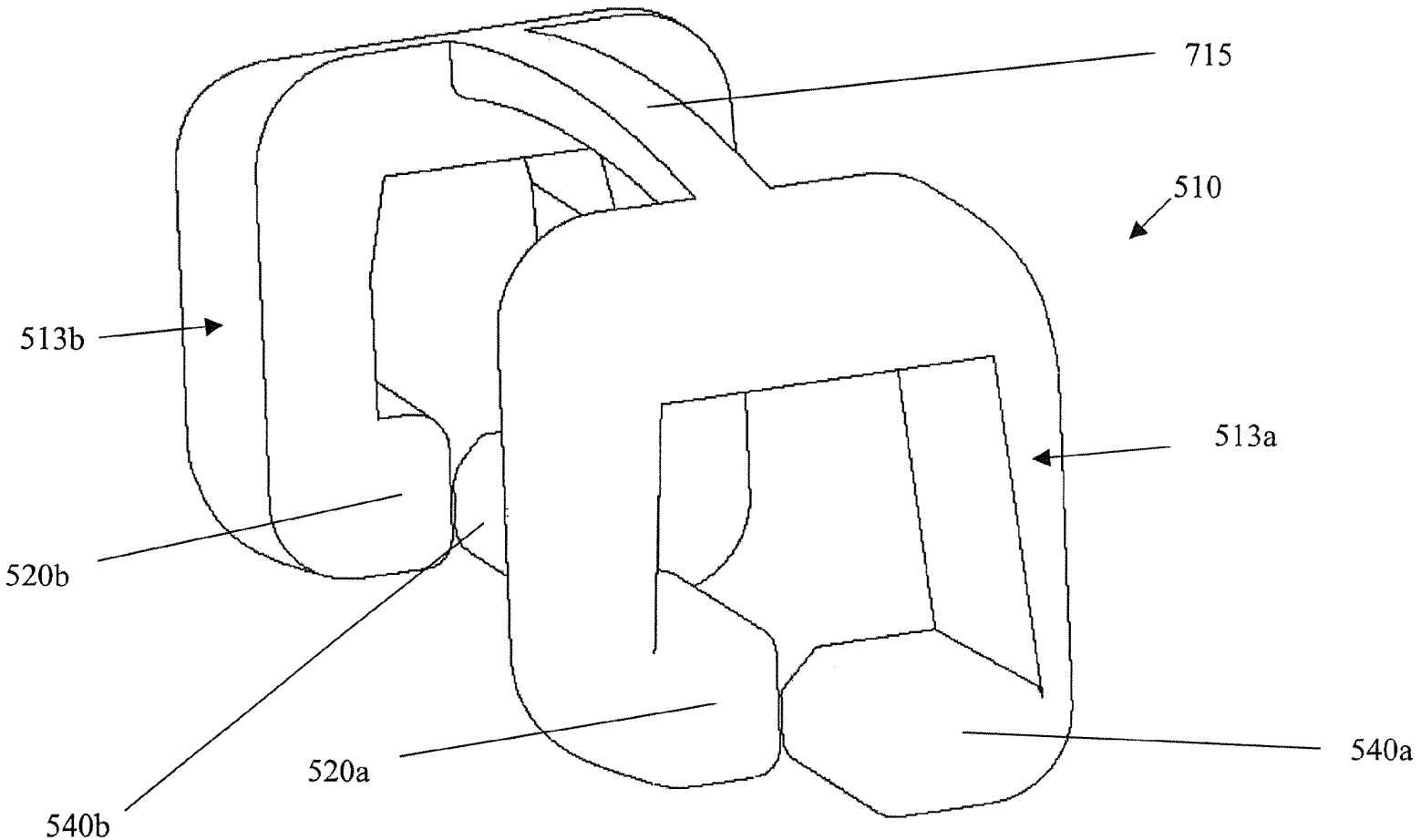
FIG. 10 is an isometric view of end portions of the slider shown in FIG. 5.
Figure 11:
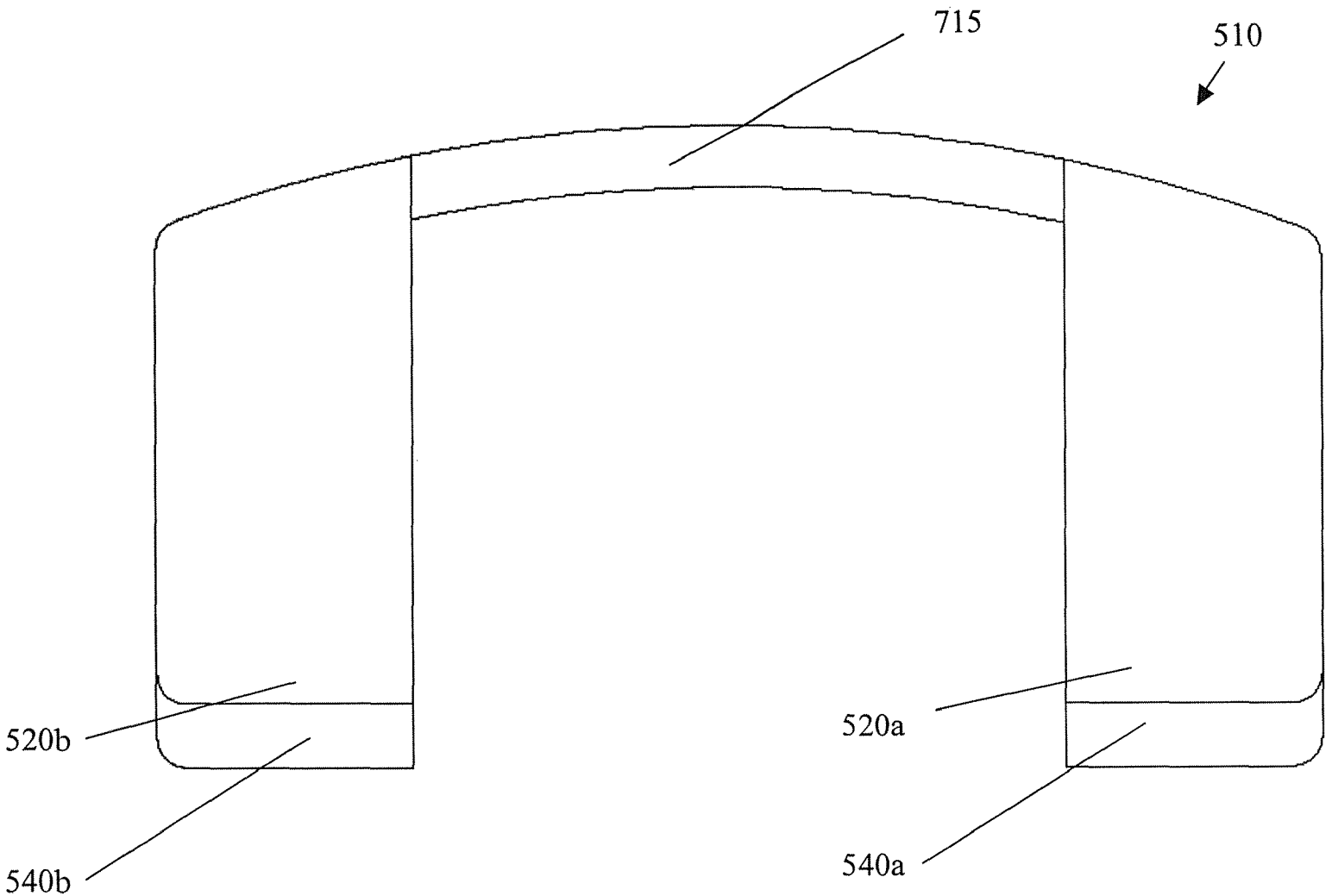
FIG. 11 is a side view of end portions of the slider shown in FIG. 5.
Figure 12:
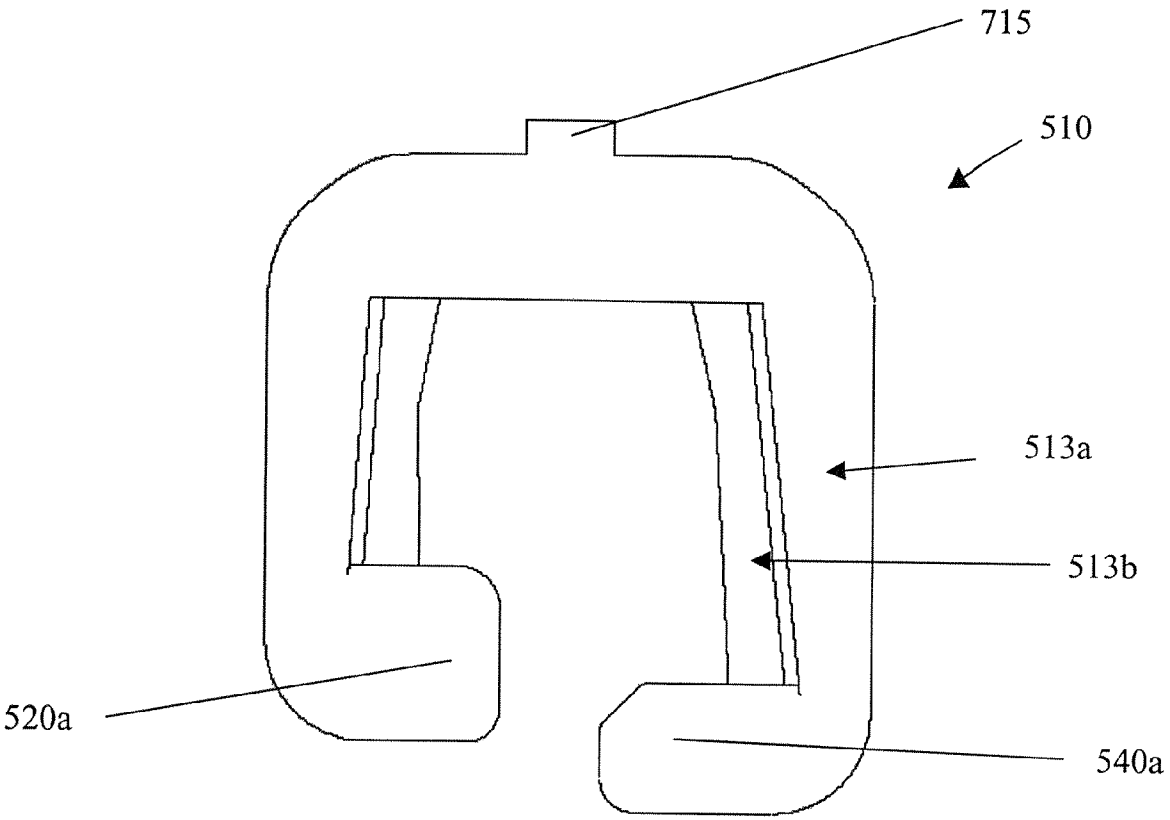
FIG. 12 is a rear end view of end portions of the slider shown in FIG. 5.

FIGS. 10-12 illustrate isometric, side and end views, respectively, of the second portion 510 of the embodiment of the slider shown in FIGS. 5-8. The second portion 510 of the slider 500, in this embodiment includes end portions 513*a,b* and connecting rail 715. The second portion 510 is illustrated alone, without the core portion 550 for clarity. Any of a variety of suitable alternative configurations and constructions to provide a smooth contour, preferably without exposed sharp corners, can be used, as previously described.

Further, in accordance with another aspect of the invention, a method of processing a product in a plastic bag having a fastener is provided. The method includes providing a plastic bag having first and second track portions and a slider to engage and disengage the first track portion respective the second track portion. The slider includes a core portion made of a first material having a first predetermined hardness and an end portion made of a second material, preferably arranged at opposing ends of the slider. The second material has a second predetermined hardness, which is less than the first predetermined hardness. The method further includes inserting a product into the plastic bag and processing the plastic bag and product in a pressurized environment, such as high pressure pasteurization as is known.

The method can further include processing the plastic bag and product by bringing the plastic bag and product to a predetermined pressure and/or a predetermined temperature, drying at least a predetermined region of the plastic bag and sealing the plastic bag in the predetermined region.

As an alternative, the method can include treating the product and reclosable bag prior to affixing the first and second track portions to the panels of the bag. In this manner, a slider having end portions formed of less rigid material is not required, although still preferred.

Alternatively still, in accordance with the invention, a method of processing a product can include treating the product and reclosable bag prior to affixing the slider to the panels of the bag. In this manner, a slider having end portions formed of less rigid material is not required.

In a further alternative embodiment, a closure system, including a slider and track portion, is provided. The system includes, in addition to the slider described herein, a track made from preselected materials and/or having a preselected shape to inhibit damage to package films undergoing high pressure processing. For example, male and female tracks can be provided made entirely or partially from a relatively soft material. In this manner, softer materials can be utilized throughout or only in regions of the tracks that come into close contact with packaging film. Alternatively, a geometry can be provided such that the tracks have smoother contours than would otherwise provided in existing tracks for reclosable fasteners. In this manner, damage to packaging films can be further prevented for packages undergoing high pressure processing.

The methods and systems of the present invention, as described above and as shown in the drawings, provide for processing of a package and product under pressurization or pressurization and heat, and providing the package with a reliable seal. These objectives may be accomplished by way of alternate systems and methods.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

What is claimed is:

1. A fastener for a plastic bag comprising:

a first track portion;

a second track portion engageable with the first track portion; and a slider to engage and disengage the first track portion respective the second track portion with one another, the slider having a longitudinal axis aligned with the first and second track portions and including:

a core portion made of a first material having a first preselected material property, the core portion including a separation finger to engage and disengage the first track portion with the second track portion; and an end portion made of an elastomer, arranged at opposing ends of the longitudinal axis of the slider, the elastomer having a second preselected material property.

2. The fastener of claim 1, wherein the first preselected material property is a first modulus of elasticity and the second preselected material property is a second modulus of elasticity.

3. The fastener of claim 2, wherein the second modulus of elasticity is less than the first modulus of elasticity.

4. The fastener of claim 1, wherein the first preselected material property is a first hardness and the second preselected material property is a second hardness.

5. The fastener of claim 4, wherein the second hardness is less than the first hardness.

6. The fastener of claim 1, wherein the core portion of the slider is centrally located along the longitudinal axis of the slider.

7. The fastener of claim 1, wherein the core portion of the slider is made of polypropylene.

8. The fastener of claim 1, wherein the elastomer is a thermoplastic elastomer.

9. The fastener of claim 1, wherein the end portion comprises a separate member at each opposing end of the slider.

10. The fastener of claim 1, wherein the core portion and the end portion of the slider are joined by a press-fit.

11. The fastener of claim 1, the core portion and the end portion of the slider are integrally molded.

12. The fastener of claim 1, wherein the end portion is molded over the core portion, covering an exterior surface of the core portion.

13. The fastener of claim 1, wherein the core portion and the end portion of the slider are joined by an interference fit, a solvent weld or a heat weld.

14. A slider for a plastic bag having a first track portion and a second track portion engageable with the first track portion, the slider being capable of engaging and disengaging the first track portion respective the second track portion from one another, the slider having a longitudinal axis aligned with the first and second track portions and including:

a core portion, made of a first material, having a first preselected material property, the core portion including a separation finger to engage and disengage the first track portion with the second track portion; and an end portion made of an elastomer, arranged at opposing ends of the longitudinal axis of the slider, the elastomer having a second preselected material property.

15. The slider of claim 14, wherein the first preselected material property is a first modulus of elasticity and the second preselected material property is a second modulus of elasticity.

16. The slider of claim 15, wherein the second modulus of elasticity is less than the first modulus of elasticity.

17. The fastener of claim 15, wherein the second modulus of elasticity is about 1 MPa to about 25 MPa.

18. The slider of claim 14, wherein the first preselected material property is a first hardness and the second preselected material property is a second hardness.

19. The slider of claim 18, wherein the second hardness is less than the first hardness.

20. The fastener of claim 18, wherein the second hardness is about 12 to about 40 on the Shore D scale.

21. The fastener of claim 14, wherein the end portion is a single member extending along the core portion to the opposing ends of the slider.

22. The fastener of claim 21, wherein the end portion comprises a connecting rail to connect opposing ends of the end portion.

23. The fastener of claim 22, wherein the core portion includes a groove into which the connecting rail is secured.

24. A slider for a plastic bag having a first track portion and a second track portion engageable with the first track portion, the slider being capable of engaging and disengaging the first track portion respective the second track portion with one another, the slider having a longitudinal axis aligned with the first and second track portions and consisting essentially of:

a core portion made of a first material having a first preselected material property, the core portion having opposing ends and a separation finger to engage and disengage the first track portion with the second track portion; and an end portion made of an elastomer arranged over at least a part of the core portion at opposing ends of the longitudinal axis of the slider, the elastomer having a second preselected material property.

25. The slider of claim 24, wherein the end portion is arranged over an outer surface of the core portion substantially in its entirety.

26. A fastener for a plastic bag comprising:

a first track portion;

a second track portion engageable with the first track portion; and a slider to engage and disengage the first track portion respective the second track portion with one another, the slider having a longitudinal axis aligned with the first and second track portions and consisting essentially of:

a core portion made of a first material having a first preselected material property, the core portion including a separation finger to engage and disengage the first track portion with the second track portion; and an end portion made of an elastomer, arranged at opposing ends of the longitudinal axis of the slider, the elastomer having a second preselected material property.

* * * * *